US006447212B2

(12) United States Patent
Orsat

(10) Patent No.: US 6,447,212 B2
(45) Date of Patent: Sep. 10, 2002

(54) SYSTEM FOR ATTACHING A REINFORCING BAND TO A WALL OF A SUPPORTING STRUCTURE AND A DEVICE FOR PLACING THE SAID SYSTEM

(75) Inventor: Pierre Orsat, Noisy le Roi (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/756,091

(22) Filed: Jan. 8, 2001

(30) Foreign Application Priority Data

Jan. 7, 2000 (FR) ..... 00 00178

(51) Int. Cl.[7] ..... F02D 29/02

(52) U.S. Cl. ..... 405/262; 405/284; 405/285; 405/286

(58) Field of Search ..... 405/262, 284, 405/285, 286; 52/309.11, 426

(56) References Cited

U.S. PATENT DOCUMENTS

| | | | | |
|---|---|---|---|---|
| 4,273,476 A | * | 6/1981 | Kotulla | 405/262 |
| 4,343,571 A | | 8/1982 | Price | 405/284 |
| 5,568,998 A | * | 10/1996 | Egan et al. | 405/262 |
| 5,624,211 A | | 4/1997 | Anderson et al. | 405/286 |
| 5,642,968 A | * | 7/1997 | Anderson et al. | 405/286 |
| 5,839,855 A | * | 11/1998 | Anderson et al. | 405/262 |
| 5,975,810 A | * | 11/1999 | Taylor et al. | 405/262 |
| 6,186,703 B1 | * | 2/2001 | Shaw | 405/262 |
| 6,224,295 B1 | * | 5/2001 | Price et al. | 405/262 |

FOREIGN PATENT DOCUMENTS

| | | | |
|---|---|---|---|
| EP | 0 130 949 A | 1/1985 | E02D/29/02 |
| EP | 0 534 475 A | 3/1993 | B28B/23/00 |
| FR | 2 773 372 A | 7/1999 | E02D/29/02 |
| GB | 1 050 789 A | 12/1966 | |
| WO | WO 84 02510 A | 7/1984 | B66C/1/18 |

* cited by examiner

*Primary Examiner*—Heather Shackelford
*Assistant Examiner*—Frederick L. Lagman
(74) *Attorney, Agent, or Firm*—Pennie & Edmonds LLP

(57) ABSTRACT

The system for attaching a reinforcing band to a wall (2) of a reinforced supporting structure comprises a winding support (10) for the reinforcing band and two staples **(11*a*, 11*b*) for fixing the winding support (10) to the wall (2), which are formed from a loop of non-corrodible material. The placement device comprises a template for shaping the loop and forming the two staples (11*a*, 11*b*), two pairs of collars, mounted on the template and intended for laterally holding the two staples (11*a*, 11*b*) respectively along the template, and two spacers, each extending between the collars of one pair to ensure. a parallel arrangement between the two branches of each staple (11*a*, 11*b*)**.

12 Claims, 3 Drawing Sheets

SYSTEM FOR ATTACHING A REINFORCING BAND TO A WALL OF A SUPPORTING STRUCTURE AND A DEVICE FOR PLACING THE SAID SYSTEM

The invention relates to a system for attaching a reinforcing band to a wall of a reinforced supporting structure. Such supporting structures are provided in the case of embankments, or even cuttings, in the area of the construction of roads, quays, motorways, buildings and other constructions of building and public works sector.

The reinforced supporting structures of embankments, or cuttings, comprise a facing wall, generally of concrete, and, between the body located at the rear and the facing wall, a specific fill of granular material reinforced by linear reinforcing bands extending in a plurality of superimposed horizontal planes. The reinforcing bands are fixed to the facing wall by means of an attachment system.

An attachment system is known comprising a pin on which the reinforcing band is wound, mounted in two attachment loops or staples of plasticised or galvanised steel. The two staples are sealed in the facing wall and coupled by a metal connecting rod embedded in the wall, ensuring good anchoring of the staples in the wall.

However, the attachment systems of this type are exposed to a risk of corrosion, in particular of the rod for coupling the two staples.

The present invention aims to overcome this disadvantage.

To this end the invention relates to a system for attaching a reinforcing band to a wall of a reinforced supporting structure, comprising a winding support for the reinforcing band and two staples for fixing the winding support to the wall, characterised in that the two staples are formed from a loop of non-corrodible material.

Thus the two staples both extend each other in a continuous manner. The loop of non-corrodible material, partially embedded in the wall, guarantees good anchoring of the staples without any risk of corrosion.

The loop is advantageously of plastic material.

The loop can comprise a core of polyester fibres, which ensures the mechanical strength of the band.

The loop preferably comprises a polyethylene sheath.

The wall of the supporting structure in which the loop of the attachment system is partially embedded is generally of concrete. However, concrete is an alkali medium which may damage the polyester fibres. The polyethylene sheath makes it possible to protect the polyester fibre core.

It is also advantageous that the loop is formed from a band wound on itself.

The staples preferably include the two ends of the band.

In this way it is possible to avoid the risks of the polyester fibre core of the loop deteriorating at the two ends of the band.

The invention also relates to a device for placing the afore-mentioned attachment system on a wall of a reinforced supporting structure, comprising a template for shaping the loop and forming the two staples.

Means are advantageously provided for positioning the two staples along the template.

Means are also advantageously provided to ensure that the two branches of each staple are parallel.

As an intermediate product, the invention also relates to an assembly of two fixing staples for the above-described attachment system, characterised in that the two staples are formed from a loop of non corrodible material.

The invention will be better understood with the aid of the following description of a particular embodiment of the attachment system and of its placement device in accordance with the invention, with reference to the attached drawing in which.

Figure 1:
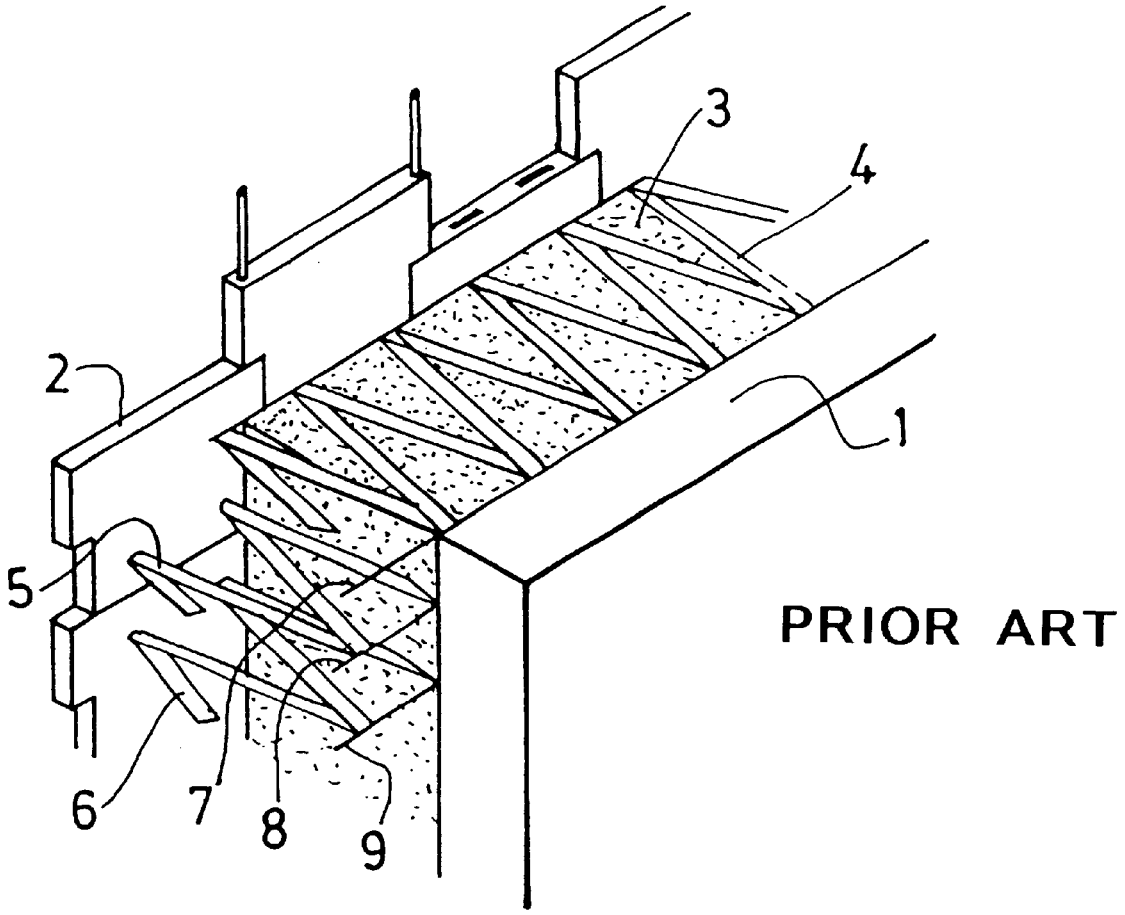
FIG. 1 shows a perspective view of a supporting structure.

The attachment system of the invention is intended to attach a reinforcing band to a facing wall of a supporting structure such as that shown in FIG. 1. This structure, which supports a solid mass 1, comprises, between the facing wall 2 and the body 1, a specific fill 3 reinforced by reinforcing bands 4–6 which extend in a plurality of superimposed planes. The wall 2 is formed by the assembly of a plurality of panels. Each reinforcing band 4–6 passes to and fro in a zig-zag manner between a diverting bar 7–9, located close to the solid mass 1, and the facing wall 2 to which it is attached with the aid of the attachment system which will now be described.

Figure 2:
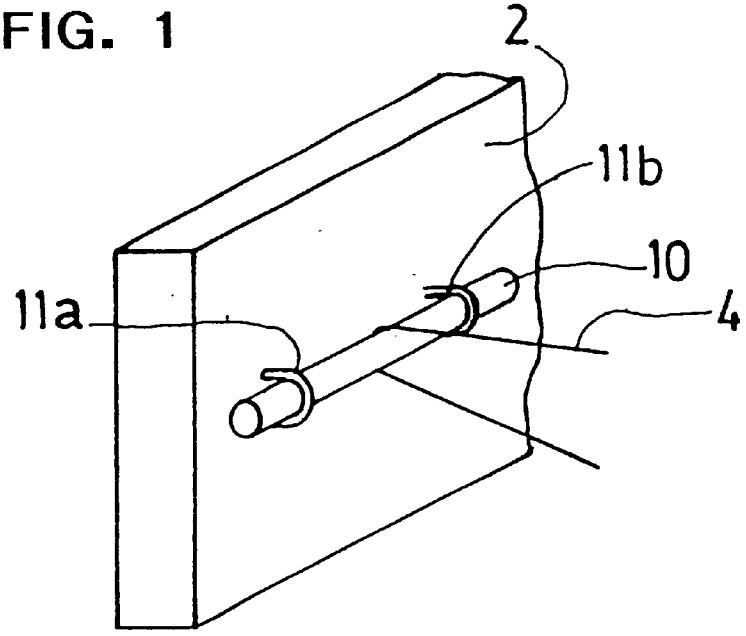
FIG. 2 shows a perspective view of an attachment system in accordance with the invention, fixed to a wall.
Figure 3:
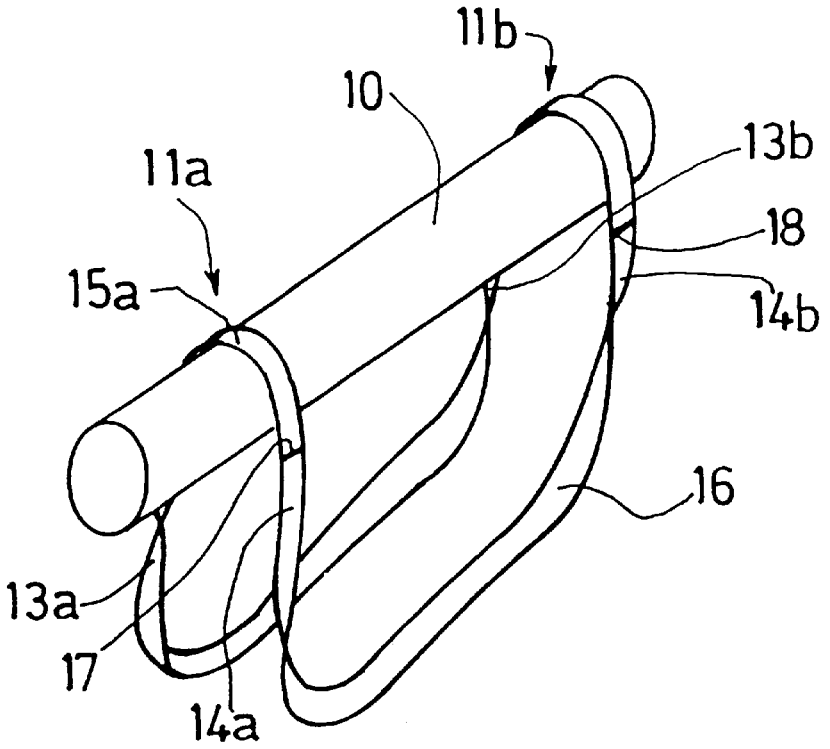
FIG. 3 shows a perspective view of the attachment system of FIG. 2, leaving out the wall.

In FIG. 2 the attachment system comprises a winding support 10 for a reinforcing band 4, or pin., and two staples 11*a*, 11*b* which fix the winding support 10 to the wall 2 and protrude out of the wall 2.

Figure 4:
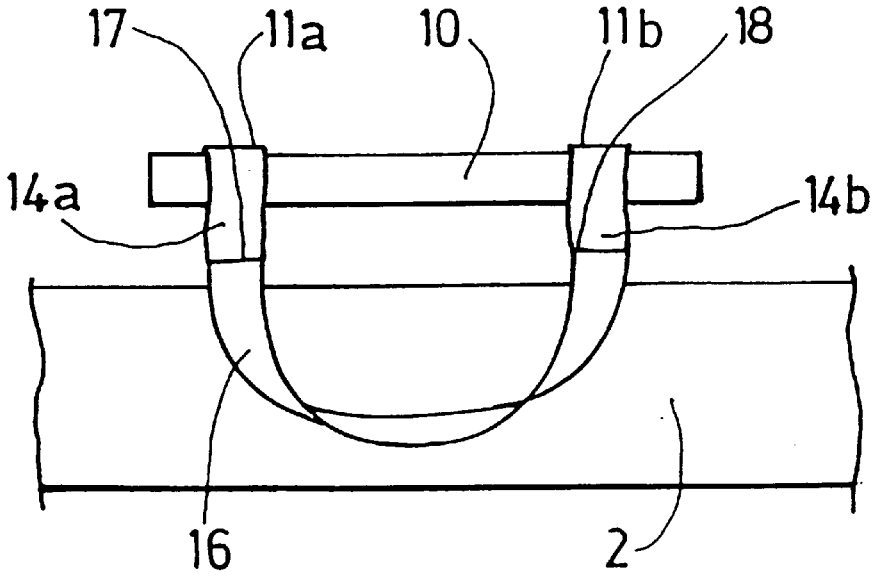
FIG. 4 shows a lateral view of the attachment system of FIG. 2.

The staples 11*a*, 11*b*, which are perpendicular to the wall 2 and face each other, are spaced by a distance less than the length of the pin 10. Each staple 11*a* (11*b*) comprises two substantially parallel branches 13*a*, 14*a* (13*b*, 14*b*) connected by a curved part 15*a* (15*b*). The distance between the two branches 13*a*, 14*a* (13*b*, 14*b*) of a staple 11*a* (11*b*) is substantially equal to the diameter of the pin 10. The two staples 11*a*, 11*b* are formed from a basic loop 16. When placed flat, this loop 16 is of a generally oval shape and comprises two parallel portions connected to each other by two U-shaped connecting portions. In order to form the two staples 11*a*, 11*b*, the two connecting portions are raised, the loop 16 being thus generally, and naturally, in the form of a gondola. As it is possible to see in FIG. 4, the loop 16 is partially embedded in the wall 2 from which it protrudes by the two staples 11*a*, 11*b*. These thus both extend by two loop portions embedded in the wall 2. By reason of the fact that the two staples form part of a single piece and are thus not isolated from each other, the loop portions connecting the two staples and embedded in the concrete ensure that the attachment system is fixed on the required part of the wall of the supporting structure. Thus the loop portions embedded in the concrete ensure excellent anchoring of the staples 11*a*, 11*b* in the wall 2.

The loop 16 is formed from a band partially wound on itself and of which the two ends 17, 18 are welded to the band. The band is of a non-corrodible plastic material. It comprises a core of polyester fibres with great mechanical strength, in particular with respect to traction, surrounded by a protective polyethylene sheath. The sheath is intended to protect the core of polyester fibres from the alkalinity of the concrete of the wall 2 and from being damaged by the aggressiveness of the fill used.

The two staples 11*a*, 11*b* include respectively the two ends 17, 18 of the band, which are thus located outside the wall 2. In this way the core of the band is at no risk of being damaged at the ends 17, 18 by the alkalinity of the concrete.

The winding support 10, also called the pin, is a cylindrical bar. It is fixed to the wall 2 by passing through the two staples 11*a*, 11*b*. A bracing band 4 is intended to be wound around the pin 10 by a half turn as shown in FIG. 2.

Figure 5:
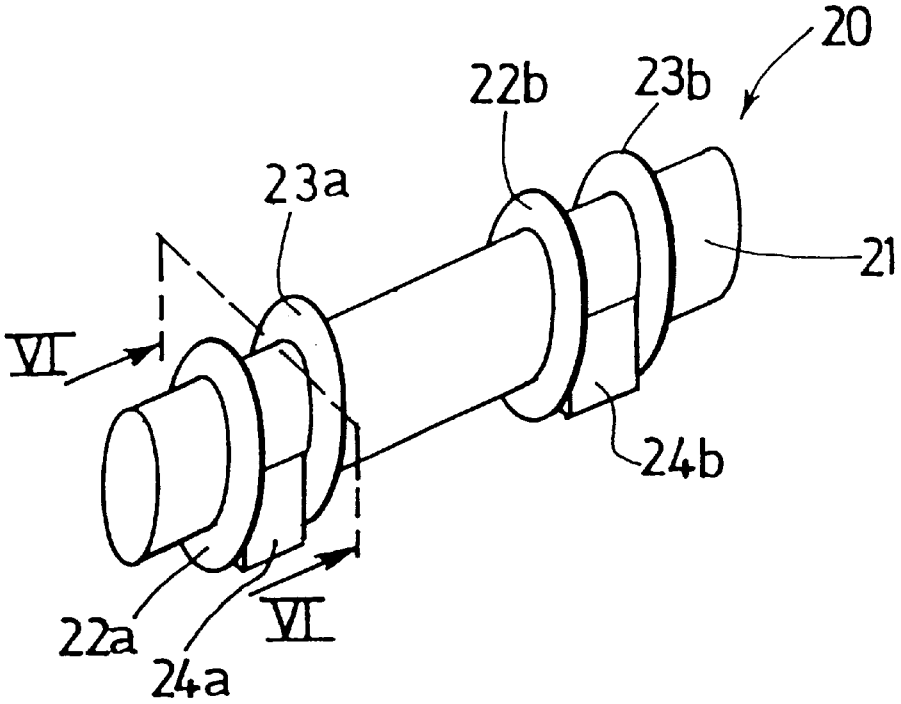
FIG. 5 shows a perspective view of the placement device for the attachment system of FIG. 2
Figure 6:
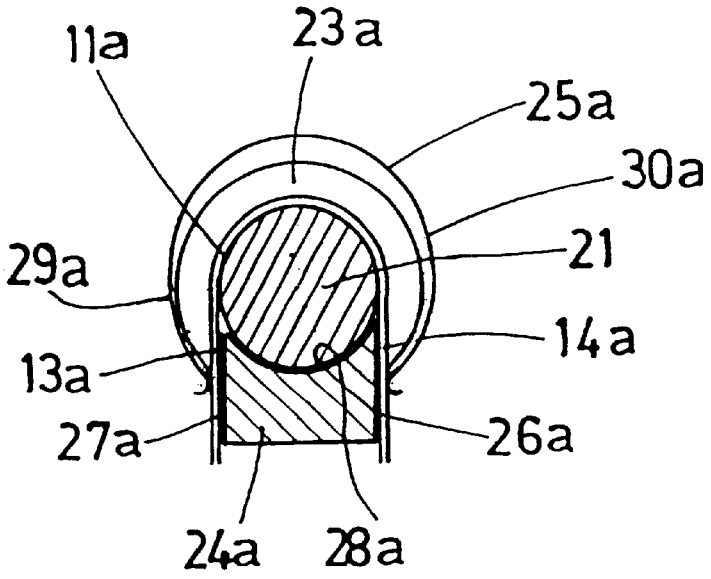
FIG. 6 shows a cross-sectional view of the placement device of FIG. 5, along the line VI—VI.

The device 20 for placement of the attachment system will now be described with reference to FIGS. 5 and 6.

This device 20 comprises a cylindrical bar 21, substantially of the same shape as the pin 10, forming a template for shaping the loop 16 and forming the two staples 11*a*, 11*b*.

Two pairs of collars, or annular flanges, 22*a*, 23*a*, 22*b*, 23*b* intended to position the staples 11*a*, 11*b* along the template 21 are mounted on the template 21 and fixedly attached thereto. Each staple 11*a* (11*b*) is intended to be held laterally along the template 21 between the two flanges 22*a*, 23*a* (22*b*, 23*b*) of a pair of flanges, the spacing between the two pairs of flanges 22*a*, 23*a*, 22*b*, 23*b* thus defining the spacing between the two staples 11*a*, 11*b*.

The placement device 20 also comprises two spacers 24*a*, 24*b* fixedly attached to the template 21, and two clips 25*a* intended to place the staples 11*a*, 11*b* against the spacers 24*a*, 24*b* in order to ensure a parallel arrangement between the branches 13*a*, 14*a*, 13*b*, 14*b* of the staples 11*a*, 11*b* over a distance at least equal to the diameter of the pin 10.

The spacers 24*a*, 24*b* are fixedly attached. to the template 21. Each spacer 24*a* (24*b*) extends between the two flanges 22*a*, 23*a* (22*b*, 23*b*) of one pair of flanges below the template 21 as shown in FIG. 5. The two spacers 24*a*, 24*b* being identical only one will now be described. The spacer 24*a* is generally in the form of a parallelepiped rectangle comprising two lateral bearing surfaces 27*a*, 28*a* which are parallel to the longitudinal axis of the template 21, and an upper surface providing a recess 28*a* for receiving the template 21. The distance between the two bearing surfaces 26*a*, 27*a* is substantially equal to the distance between the two branches 13*a*, 14*a* of the staple 11*a*.

Each clip 25*a* comprises two elastically deformable bearing arms 29*a*, 30*a* extending from one other and provided with two free bearing ends curved towards the outside. By means of their curved free ends, the two bearing arms 29*a*, 30*a* are intended to place the two branches 13*a*, 14*a* of the staple 11*a* against the two bearing surfaces 26*a*, 27*a* of the spacer 24*a* to ensure a parallel arrangement between the two branches 13*a*, 14*a* of the staple 11*a* and to keep the loop 16 in shape when the attachment system is being placed.

The operation of placing the above-described attachment system with the aid of the placement device 20 will now be explained.

The concrete panels forming the wall 2 are produced by flat moulding. During manufacture of a panel, the placement device 20 is positioned above the mould, the spacers 24*a*, 24*b* extending below the template 21, and the template 21 is prevented from rotating. The as-yet-unshaped loop 16 is then brought in.

In order to form the staple 11*a*, the loop 16 is shaped by laying it against the upper part of the template 21, between the two flanges 22*a*, 23*a* of a pair of flanges, and against the bearing surfaces 26*a*, 27*a* of the spacer 24*a*. The clip 25*a* is then positioned by being made to straddle the template 21, by a vertical downwards movement, between the two flanges 22*a*, 23*a*. By means of their curved free ends, the two arms 29*a*, 30*a* of the clip 25*a* place and hold the two branches 13*a*, 14*a* of the staple 11*a* against the two bearing surfaces 26*a*, 27*a* of the spacer 24*a*, thus ensuring the parallel arrangement between the two branches 13*a*, 14*a*.

The same procedure is carried out to form the other staple 11*b*.

Finally, the concrete is poured into the mould, partially embedding the loop 16. After the concrete is set the placement device is removed.

It will be emphasized that, when the concrete is poured, the clips 25*a* hold the staples 11*a*, 11*b* and thus prevent any movement of the staples 11*a*, 11*b* either up or down.

The basic band from which the staples 11*a*, 11*b* are formed was implicitly flexible in the description just given. It would be possible to envisage an attachment system using a loop of rigid or semi-rigid material.

What is claimed is:

1. A system for attaching a reinforcing band to a wall of a reinforced supporting structure, comprising a winding support for the reinforcing band and two staples for fixing the winding support to the wall, wherein the two staples are formed from a loop of non-corrodible material and thus both extend each other in a continuous manner, and wherein the loop is formed from a band wound on itself.

2. The system according to claim 1, wherein the loop is of a plastic material.

3. The system according to claim 1, wherein the staples comprise the two ends of the band.

4. A system for attaching a reinforcing band to a wall of a reinforced supporting structure, comprising a winding support for the reinforcing band and two staples for fixing the winding support to the wall, wherein the two staples are formed from a loop of non-corrodible material and thus both extend each other in a continuous manner, and wherein the loop comprises a core of polyester fibers.

5. The system according to claim 4, wherein the loop comprises a polyethylene sheath.

6. A device for placing, on a wall of a reinforced supporting structure, an attachment system comprising a winding support for the reinforcing band and two staples for fixing the winding support to the wall, wherein the two staples are formed from a loop of non-corrodible material and thus both extend each other in a continuous manner, the device comprising a template for shaping the loop and forming the two staples.

7. The device according to claim 6, wherein means are provided for positioning the two staples along the template.

8. The device according to claim 7, wherein the positioning means comprises two pairs of collars mounted on the template, intended for laterally holding the two staples respectively.

9. The device according to claim 6, wherein means is provided to ensure a parallel arrangement between the two branches of each staple.

10. The device according to claim 9, wherein the means for ensuring the parallel arrangement between the two branches of each staple comprises a spacer extending between the collars of one pair.

11. The device according to claim 10, wherein means is provided to place the two branches of the staple against the spacer.

12. An assembly of two fixing staples for an attachment system comprising a winding support for the reinforcing band and two staples for fixing the winding support to the wall, wherein the two staples are formed from a loop of non-corrodible material and both extend each other in a continuous manner, and wherein the loop is formed from a band wound on itself.

* * * * *